United States Patent [19]

Harmsen

[11] 4,111,690

[45] Sep. 5, 1978

[54] ELECTRICAL CONTACTS WITH GOLD ALLOY

[75] Inventor: Nils Harmsen, Bruchköbel, Fed. Rep. of Germany

[73] Assignee: W. C. Heraeus GmbH, Hanau am Main, Fed. Rep. of Germany

[21] Appl. No.: 819,060

[22] Filed: Jul. 26, 1977

[30] Foreign Application Priority Data

Aug. 21, 1976 [DE] Fed. Rep. of Germany ..... 2637807

[51] Int. Cl.[2] ..... C22C 5/00

[52] U.S. Cl. ..... 75/165; 75/134 N; 200/266

[58] Field of Search ..... 75/165, 134 R, 134 N; 200/266

[56] References Cited

U.S. PATENT DOCUMENTS 3,849,543 11/1974 Zirngibl et al. ..... 75/165

FOREIGN PATENT DOCUMENTS 683,004 11/1952 United Kingdom ..... 75/165

*Primary Examiner*—M. J. Andrews

*Attorney, Agent, or Firm*—Flynn & Frishauf

[57] ABSTRACT

The present invention provides a gold, silver and nickel alloy particularly useful for electrical contacts. The alloy consists essentially of 10–40% by weight silver, 2–25% palladium, 1–5% nickel, 0.1–10% indium, 0.1–3% tin, and the balance substantially gold. The invention also provides contacts comprising said alloy.

12 Claims, 2 Drawing Figures

ELECTRICAL CONTACTS WITH GOLD ALLOY

Figure 1:
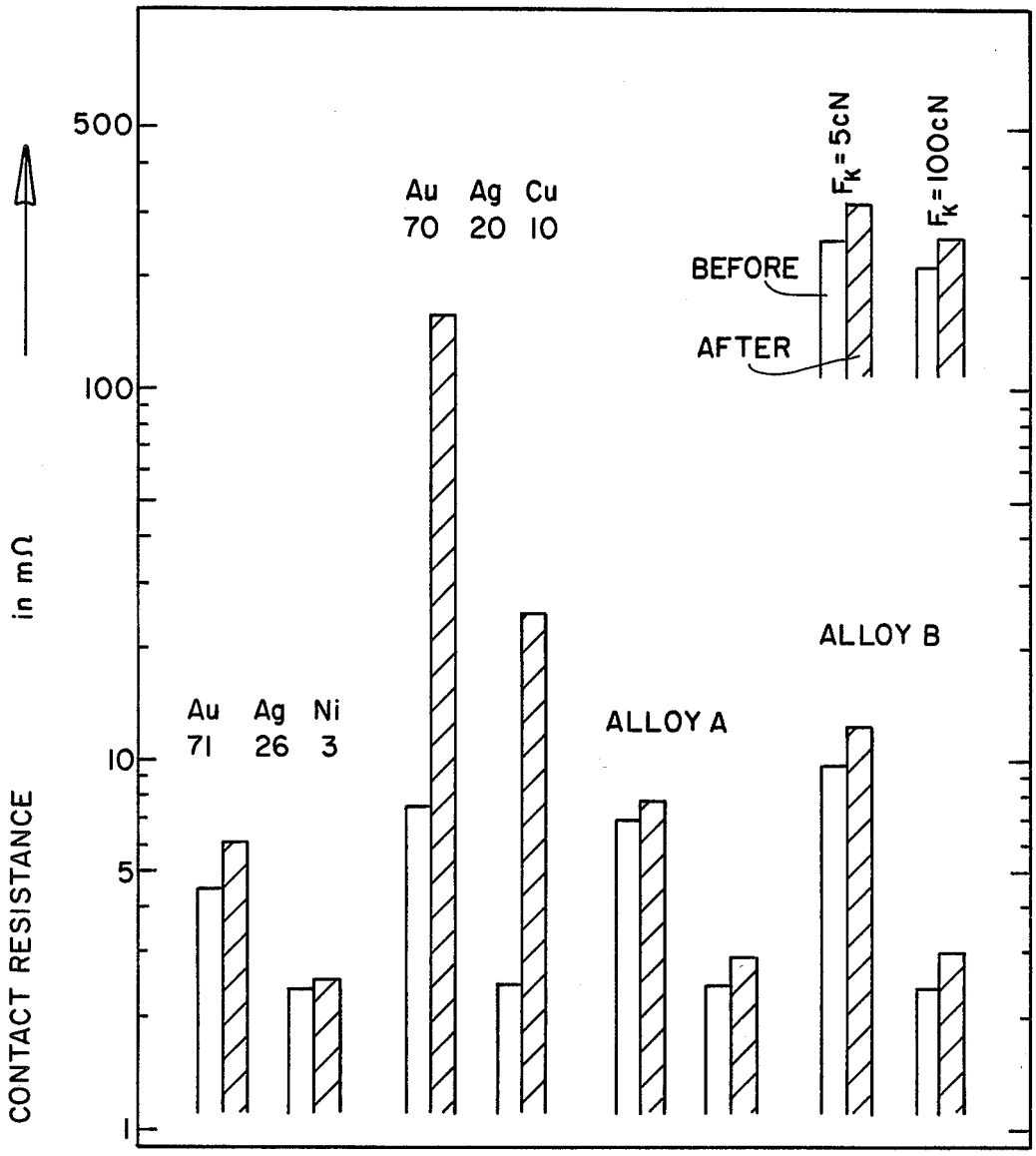

The present invention provides an alloy containing gold, silver and nickel, particularly useful for electrical contacts for low current applications.

Gold which is relatively soft is only used in special cases as an electrical contact material, particularly those which are mechanically stressed during the contact operation. However, its alloys have found a broad range of use as contact materials. Thus, for example, the alloys Au70Ag20Cu10 and Au70Ag24Cu6, both rich in gold, are widely used because of their good electrical characteristics and their good resistance to wear and tear.

The foregoing copper-containing alloys have the disadvantage that when heated in air, either with or without a current charge, for example, during spray coating of the contacts with a plastic material, or with contacts which operate in air and become heated during operation, tarnishing of the contact surface occurs which results in a covering of tarnish material leading to an increase in the contact resistance. Analysis of such tarnished surfaces have disclosed that it results because of the copper content of the aforedescribed gold-silver-copper alloys. The tarnish includes copper oxides and when in the presence of sulfur, it also includes copper sulfides.

German Offenlegungsschrift 2 019 790 discloses a copper-containing gold alloy useful for electrical contacts. It consists of 39–47% by weight of gold, 9–12% palladium, with the balance silver and copper in a weight ratio of from 1:1 to 1.5:1. The alloys disclosed can optionally contain up to 2% zinc, nickel, indium, tin and/or iridium. Although this alloy is resistant to the tarnishing effects caused by sulfur or sulfur-containing contacts, when heated in air it suffers the same disabilities as the gold-silver-copper alloys which are rich in gold, as disclosed hereinbefore.

The known alloy Au71Ag26Ni3 disclosed as a contact material has better resistance against tarnishing in air than the copper-containing alloys discussed hereinbefore, but it considerably softer and therefore less resistant to wear and tear.

It is the object of the present invention to provide a gold-silver alloy for electrical contacts which has good strength characteristics and which is also highly resistant to tarnish, and to provide contacts comprised of said alloy.

THE SUBJECT MATTER OF THE PRESENT INVENTION

The present invention provides a contact alloy consisting essentially of 10 to 40% by weight silver, 2 to 25% palladium, 1 to 5% nickel, 0.1 to 10% indium, 0.1 to 3% tin, and the balance substantially gold.

Particularly preferred alloys are disclosed in Table I, identified with the letters A, B, C and D.

TABLE I

| Alloy | Composition | | | | | |
|---|---|---|---|---|---|---|
| | Au | Ag | Pd | Ni | In | Sn |
| A | 64.8 | 25 | 5 | 3 | 2 | 0.2 |
| B | 54.8 | 25 | 15 | 3 | 2 | 0.2 |
| C | 64.8 | 25 | 5 | 3 | 0.2 | 2 |
| D | 54.8 | 25 | 15 | 3 | 0.2 | 2 |

Physical including electrical characteristics of the above-identified four alloys of the present invention, and also of, for comparative purposes, the known contact alloys Au70Ag20Cu10 and Au71Ag26Ni3 are set forth in Table II which is on the following page.

Table II

| | | AuAgCu 70/20/10 | AuAgNi 71/26/3 | Alloy A | Alloy B | Alloy C | Alloy D |
|---|---|---|---|---|---|---|---|
| Density [g . cm$^{-3}$] | | 15.0 | 15.3 | 14.7 | 14.1 | 14.8 | 14.1 |
| Electrical [mΩ$^{-1}$ mm$^{-2}$] | a | 7.3 | 7.7 | 4.9 | 4.3 | — | — |
| | b | 7.1 | 9.0 | 5.6 | 4.5 | — | — |
| Hardness HV 1 [kp . mm$^{-2}$] | a | 265 | 185 | 220 | 255 | 195 | 240 |
| | b | 140 | 90 | 100 | 125 | 85 | 230 |
| Tensile strength [N . mm$^{-2}$] | a | 865 | 630 | 725 | 850 | 690 | 820 |
| | b | 510 | 340 | 395 | 495 | 385 | 530 |

a = hard
b = soft

A test was run to determine the resistance of the alloys of the present invention to tarnishing in air, particularly when heated and when subjected to different contact pressures. Alloys A and B were tested and compared with the two known alloys Au70Ag20Cu10 and Au71Ag26Ni3. The values of the contact resistance based upon contact pressures of 5 and 100 cN contact pressure were determined before and after one minute of heating at 250° C. in air. FIG. 1 is a block diagram which represents the results of these tests. The susceptibility of the prior art alloys which contain copper is particularly apparent.

The experimental results reported in FIG. 1, and also those reported in Table II illustrate the technical advantages of the contact materials of the present invention when compared to those of the prior art, i.e., they exhibit the combination of better hardness and tensile strength together with higher resistance to tarnish. They also have the advantage of a combination of high strength and good ductility so that they may be applied as thin layers on a contact substrate, for example, by rolling. Because of the thin layers which may be applied, the contact becomes less expensive than when composed of the known gold-silver base contact alloys.

Figure 2:
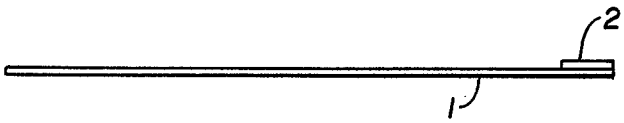

Because the alloys of the present invention do not contain copper and therefore have excellent resistance to tarnishing, they are particularly suited as contact materials for low current contacts. Such a contact is illustrated in FIG. 2 which is a cross-section through such a contact. The contact comprises a substrate material 1 coated with the contact alloy 2 of the present invention.

It is particularly preferred to use as the contact alloy of the present invention one consisting essentially of between about 20% and 30% silver, 5% and 20% palladium, 2% and 4% nickel, 0.2% and 5% indium, and 0.2% and 2% tin, and the balance is gold.

I claim:

1. A gold, silver and nickel containing alloy particularly useful for electrical contacts consisting essentially of between 10 and 40% by weight silver, 2 and 25% palladium, 1 and 5% nickel, 0.1 and 10% indium, 0.1 and 3% tin, and the balance substantially gold.

2. The alloy of claim 1 consisting essentially of 64.8% gold, 25% silver, 5% palladium, 3% nickel, 2% indium, and 0.2% tin.

3. The alloy of claim 1 consisting essentially of 54.8% gold, 25% silver, 15% palladium, 3% nickel, 2% indium, and 0.2% tin.

4. The alloy of claim 1 consisting essentially of 64.8% gold, 25% silver, 5% palladium, 3% nickel, 0.2% indium, and 2% tin.

5. The alloy of claim 1 consisting essentially of 54.8% gold, 25% silver, 15% palladium, 3% nickel, 0.2% indium, and 2% tin.

6. An electrical contact particularly useful as a low current contact comprising as the contact material an alloy consisting essentially of between 10 and 40% by weight silver, 2 and 25% palladium, 1 and 5% nickel, 0.1 and 10% indium, 0.1 and 3% tin, and the balance substantially gold.

7. The electrical contact of claim 6 wherein said alloy consists essentially of 64.8% gold, 25% silver, 5% palladium, 3% nickel, 2% indium, and 0.2% tin.

8. The electrical contact of claim 6 wherein said alloy consists essentially of 54.8% gold, 25% silver, 15% palladium, 3% nickel, 2% indium, and 0.2% tin.

9. The electrical contact of claim 6 wherein said alloy consists essentially of 64.8% gold, 25% silver, 5% palladium, 3% nickel, 0.2% indium, and 2% tin.

10. The electrical contact of claim 6 wherein said alloy consists essentially of 54.8% gold, 25% silver, 15% palladium, 3% nickel, 0.2% indium, and 2% tin.

11. The alloy of claim 1 consisting essentially of between about 20% and 30% silver, 5% and 20% palladium, 2% and 4% nickel, 0.2% and 5% indium, and 0.2% and 2% tin.

12. The electrical contact of claim 6 wherein said alloy consists essentially of between about 20% and 30% silver, 5% and 20% palladium, 2% and 4% nickel, 0.2% and 5% indium, and 0.2% and 2% tin.

* * * * *